United States Patent [19]

Hayami et al.

[11] 4,070,208

[45] Jan. 24, 1978

[54] METHOD FOR THE MANUFACTURE OF A RIDGING-FREE FERRITIC STAINLESS STEEL SHEET

[75] Inventors: Satohiro Hayami, Yokohama; Munetsugu Matsuo, Kawasaki; Soichi Izumi; Ryoji Terakado, both of Muroran, all of Japan

[73] Assignee: Nippon Steel Corporation, Tokyo, Japan

[21] Appl. No.: 756,423

[22] Filed: Jan. 3, 1977

[51] Int. Cl.[2] ..... C21D 9/48

[52] U.S. Cl. ..... 148/12 EA

[58] Field of Search ..... 148/12 EA, 12 E

[56] References Cited

U.S. PATENT DOCUMENTS

| | | | |
|---|---|---|---|
| 2,905,577 | 9/1959 | Harris et al. | 148/12 EA |
| 3,128,211 | 4/1964 | Waxweiler | 148/12 EA |
| 3,655,459 | 4/1972 | Brickner et al. | 148/12 EA |

*Primary Examiner*—W. Stallard

*Attorney, Agent, or Firm*—Wenderoth, Lind & Ponack

[57] ABSTRACT

A slab or ingot of ferritic stainless steel for deep drawing applications is subjected to hot rolling, coiled at 450° to 750° C, subjected to warm rolling without cooling the coil by a rolling mill installed separately from the hot strip rolling mill, subjected to continuous annealing, and subjected to cold rolling and final annealing.

3 Claims, 9 Drawing Figures

METHOD FOR THE MANUFACTURE OF A RIDGING-FREE FERRITIC STAINLESS STEEL SHEET

BACKGROUND OF THE INVENTION

This invention relates in general to ferritic stainless steels for deep drawing purposes and, more particularly, it pertains to methods for producing stainless steels of the type exemplified by AISI classification type 430 that can be used for deep drawing without an unsightly defect known as "ridging", "roping" or "washboard". Ridging manifests itself when the metals are unidirectionally rolled into sheet, strip or coil and occurs when such a product is subjected to cold forming operation such as deep drawing. Ridging is a condition that is characterized by the formation of alternate ridges and grooves, similar to corrugations, which are parallel to the rolling direction of the metals. This surface defect is of course detrimental to the appearance of the formed article, and expensive grinding and polishing operations are required to suitably improved the appearance. Another drawback to the use of the ferritic stainless steels in forming operations is their poor formability, particularly their deep drawability. Therefore these problems of ridging and formability are regarded as the major obstacles that must be overcome if the production of ferritic stainless steels is to expand significantly. It is an object of the invention to provide procedures of producing ferritic stainless steels free from ridging with excellent deep drawability, which are realized with an extra merits of reducing the number of processes and eliminating difficulties in mill operations.

DESCRIPTION OF THE PRIOR ART

Over the years, a great deal of work has been done on the ridging problem. It is well established that ridging in ferritic stainless steel is a manifestation of the anisotropic plasticity of bands which have developed primarily during the hot rolling stages of production. Several methods were successful in reducing ridging to some extent. Particularly U.S. Pat. No. 3,128,211 claims the process for minimizing ridging by control of the grain characteristics through the chemistry of the steel, the production of equiaxed fine grain ingot by special expedients, the low temperature hot rolling and the cold rolling in at least two rolling stages followed by an intermediate anneal between the stages. This method has been widely employed in the mills, but it involves operational difficulties of the low temperature hot rolling to roll the hard metals in the state of high deformation resistance, which results in the expensive cost of installation of high power rolling mills and the frequent occurrence of surface flaws. The low temperature hot rolling is effectuated by interrupting the hot rolling and tabling the material on the train of hot rolling mill, so that this procedure reduces the productivity of hot mill considerably. Moreover, in order to attain low ridging tendency it has to be followed by the cold rolling in at least two stages in contrast to the single stage cold rolling in the production of low carbon steel sheets for deep drawing applications. The purpose of this new invention is that the ferritic stainless steels can be produced in the same rolling processes as the low carbon steel, namely the normal hot rolling instead of low finishing and the single stage cold rolling, only by using a supplementary procedure that can be easily processed in an "off-line" expedient without recourse to the processing in the hot mill line.

On the other hand the deep drawing performance of steel sheets has been known to be related to its plastic strain ratio. The plastic strain ratio, *r*, is defined as the ratio of the width-strain to the thickness-strain determined by the tension testing of sheet specimens and is a measure of the resistance to thinning during the cold forming of sheet material. Furthermore the plastic strain ratio depends mainly upon the crystallographic texture oriented parallel to the rolling plane of the materials. The planar anisotropy of *r*-values in a sheet, namely the differences in *r*-values in the longitudinal, diagonal and transverse directions to the rolling direction, is determined by the directionality of the crystallographic texture with respect to the rolling direction of the material. If the *r*-values in various directions of a sheet differ significantly, earing occurs in the cup drawn from the material. Consequently for the purpose of enhancing deep drawability, the ferritic stainless steels need to be processed so as to provide not only high $\bar{r}$-valued but also planar isotropic sheets. The conventional methods for increasing r-value involves control of the chemistry of the steel as claimed typically in U.S. Pat. No. 3,713,813, which is explained to be processed by the low temperature hot rolling and the two stage cold rolling. In contrast to the conventional methods it is another purpose of this invention that the deep drawability can be enhanced without dependence on the chemistry of the metals.

DESCRIPTION OF THE PREFERRED EMBODIMENTS

Figure 1A:
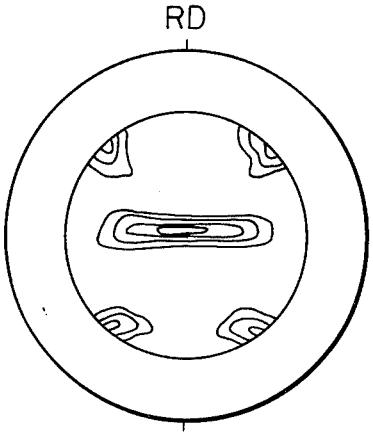
FIGS. 1*a*, 1*b* and 1*c* are {100} pole figures of annealing textures in a ferritic stainless steel rolled at 850° and 20° C, respectively. The texture of material warm rolled at 550° C is characterized by wide spread of orientation.
Figure 1B:
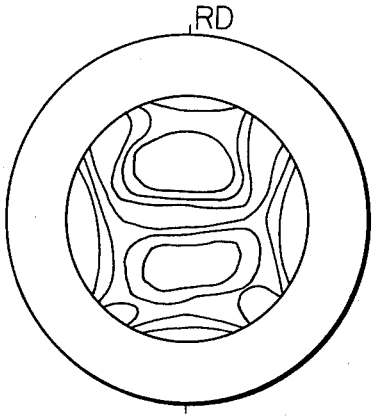
Figure 1C:
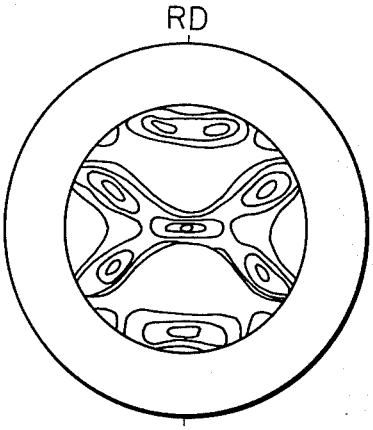

For the purpose of producing the ferritic stainless steels steels with minimum ridging and excellent drawability, control of the crystallographic texture is an essential requirement. As stated before, the deep drawability depends primarily on the texture. The ridging phenomenon originates as a manifestation of the anisotropic plasticity of contrasting textures. The inventors have found a novel ridging phenomenon in Ti-stabilized extra low carbon ferritic stainless steels which was produced by the conventional method and a sharp {554}<255> oriented crystallographic texture fabourable for the deep drawability was developed remarkably. The novel ridging occurs most conspicuously in the tensile deformation diagonal to the rolling direction in contrast to the occurrence of the conventional ridging in the longitudinal tensile deformation and is analysed to be caused by a manifestation of the anisotropic plasticity of bands of the contrasting orientation, namely (554) [225] and (554) [$\bar{2}\bar{2}5$], in the tensile deformation in the diagonal direction. Consequently the best way of texture control for improving ridging tendency and drawability is shown to disperse the directionality of texture in the rolling direction with maintaining the favourable orientation for drawability parallel to the rolling plane. The said desired controlling process is one of essential features of this invention.

In an extensive research of texture formation in the ferritic stainless steels. The inventors have found the condition of desirable texture formation. There are three kinds of textures typically classified by the temperature of rolling. In the hot rolling including the low temperature finish, distinct texture variation occurs through thickness of the rolled sheet as a consequence of annealing process in the hot rolling. Especially very strong texture oriented in {100}<011> prevails in the central part and remains after cold rolling and annealing. The texture deteriorates the deep drawability and necessiates to be diminished in at least two stage cold rolling, since it is the most harmfull texture to the deep drawability. In the cold rolling crystals tend to align their <011> crystal axis in the rolling direction and to reorient in {554} <225> orientations after annealing. Further repetition of cold rolling and annealing brings in an increase in the degree of planar anisotropy of *r*-values.

Another kind of texture which the inventors have found is formed in the warm rolling. The warm rolling means the rolling during which recrystallization does not occur in contrast to the hot rolling accompanied with progress of recrystallization at least in part.

Rolling of the ferritic stainless steel in the temperature range of 750° and 450° C develops a blunt texture characterized by weak tendency in the directionality, which is retained after cold rolling and annealing and contributes to minimize ridging tendency and to reduce planar anisotropy of r value with high average value. Thus the inventors have found a significant improvement of the deep drawability of the ferritic stainless steels. There is another metallurgical aspect of improvement brought in by warm rolling.

As mentioned before, ridging is a manifestation of the anisotropic plasticity of bands so that bands, which consist of elongated grains formed in the hot rolling stage, are needed to be diminished.

In the temperature range of 500° and 700° C, the difference of deformation resistance between ferrite and austenite are very large. When the steels are rolled before decomposition of the austenite in the said temperature, the soft ferrite deforms in preference to the hard austenite so that shear deformation bands grow extensively by cutting through the elongated grains and the bands are broken up. This is a distinct advantage of the warm rolling superior to the hot rolling in which ferrite and austenite deforms equally into elongated grains and bands are formed extensively. The elongated austenite leaves carbides aligned in the rolling direction after its decomposition and binders the break-up of bands in subsequent processings. Hence the warm rolling is shown to exert strong contributions to improvements on both the ridging and the drawability of the ferritic stainless steels.

Furthermore it is found that the warm rolling provides an effective basis for simplification of following processings. In the conventional methods, the hot rolled material is subjected to box anneal. An open or continuous short time anneal of the hot rolled structure has not been found to be as effective as a box anneal.

However, a continuous short time anneal is more effective in the warm rolled material by inducing complete recrystallization of the warm rolled structure and elimination of the bands. It is well known that the recrystallization proceeds driven by the residual strains stored in the materials. Since the strains are relieved in rolling and coiling operations in the hot rolled sheet, the driving force to recrystallization is weak. The warm rolling is advantageous in storing the strains, since recrystallization does not occur in the rolling.

Also the low temperature hot rolling is fairly effective to retain the strains. However contrary to the conventional concept the bands are found to be broken up by recrystallization more extensively in a continuous short time anneal rather than in a box anneal. This taught us that the strains can be retained enough to induce recrystallization during heating in a short time in the materials which has been suitably processed as in the warm rolling and the continuous anneal is profitable not only in productivity but also in quality improvement of the ferritic stainless steels.

The annealed product is descaled and then cold rolled. In the conventional methods the cold rolling is divided into at least two stages with an intermediate anneal between the stages. This consumes the cost of production. The warm rolling saves the cost, since the warm rolling followed by the single stage cold rolling can provide an excellent deep drawability with regard to both ridging and plastic anisotropy. The two stage cold rolling following the warm rolling is not favourable, since the cold rolling tends to destroy the desirable texture formed in the warm rolling. So far the warm rolling is shown to be the most effective means for improving the deep drawability with minimum ridging and for stream lining the production of the ferritic stainless steels.

Now the inventors disclose a desirable procedure of the warm rolling in the hot mills. The modern hot strip mill is characterized by its rolling at high velocity. When the rolling velocity is high, the ferritic stainless steels have high deformation resistance even in the hot rolling. Therefore frequent occurrence of the surface flaws is unavoidable particularly during the pass of finish train at low temperature. In the present procedure the material is hot rolled without interruption by tabling at the finishing temperature above 900° C where the ferritic stainless steels are as soft as the low carbon unalloyed steels. Then the hot rolled material is coiled in the temperature range of 750° and 450° C. The coiled material is transferred to a warm rolling mill. It is preferable to prevent the temperature drop of coil by a device such as hood, but, since the coiled material is very slow in the emission of its heat, the warm rolling can be operated at a temperature about 50° C lower than the coiling temperature after a lapse of half an hour from the time of coiling. The warm rolling can be effectuated as far as 60% reduction in thickness in a single or two stand rolling mill. In the single stand mill the material is reduced in double passes by reversing the progress of material, during which the material can be kept at the desirable temperature because of enough generation of heat by its rolling and slow emission of heat in the coil. The rolling can be operated at relatively low velocity in a separate mill and the material can be deformed easily at low velocity. Therefore the warm rolling mill is able to be installed cheaply and operated without sophisticated operational techniques.

In order to prevent loss of heat during rolling, the working rolls of the warm rolling mill are applied a mixture of high temperature gas and collant. By changing portion of high temperature gas and coolant the rolls and the rolled material are kept in their desirable temperature during the warm rolling.

By employing the warm rolling as a supplementary expedient, the ferritic stainless steel can be produced in the same process as the low carbon unalloyed steel and the product is characterized by freedom from ridging and excellent deep drawability.

The inventors sumarize the desirable conditions of their invention to achieve successful improvements in minimizing ridging tendency and enhancing deep drawability.

The chemistry of the metal itself is not essential in the present invention, since, as described above on the physical metallurgy basis, the principle of texture control procedures applies to ferritic stainless steels in general. Therefore the kind of the steel or application of the product. The inventors confine the steels used for deep drawing which respond to the AISI classification Type SUS 430, SUS 429 or SUS 405. Limits of these types of the AISI classification are:

Cr:—11.50 - 18.00
C: maximum—0.10
Si: maximum—1.0
P: maximum—0.04
S: maximum—0.03

Manganese may be added up to about 2% for improvement of weldability in excess of the maximum limited by the AISI classification without affecting the results produced by the present invention. Addition of carbide forming elements such as titanium and niobium is known to be effective in enhancing deep drawability both in low carbon unalloyed steels and in ferritic stainless steels. Particularly steel produced of modified type 430 containing 0.1 to 0.5 titanium, up to 0.02% carbon and up to 2% manganese provides good performance of deep drawability and high resistance of fracture after welding. However the steel is not free from ridging, particularly the new type of ridging mentioned above. The steel can be processed according to the present invention and endowed further improvement of deep drawability and freedom from ridging as shown in the example hereinafter.

The warm rolling must be carried out to make best use of its underlying metallurgical principles. In the temperature range of 700° and 450° C, especially 650° and 500° C, the texture characteristic to the warm rolling develops preferably. Also the difference of deformation resistance between ferrite and austenite is large and give rise to breaking up of bands effectively in the said temperature range. In order to substantiate the formation of desirable texture, the material needs to be rolled at least about 15% preferably in the range of 40% and 60%. In views of deformation resistance of the steels it is practically moderate that the lower limit of the rolling temperature is considered to be 450° C while the upper limit of the reduction be about 60%.

Figure 2A:
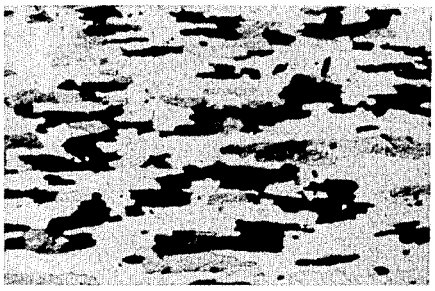
FIGS. 2*a*, 2*b* and 2*c* are metallographical micrographs showing changes of recrystallization behavior in annealing of a ferritic stainless steel warm rolled at 700° C at heating rate of 0.01 deg c/s, 1 deg c/s and 10 deg c/s, respectively. An equiaxed fine grain structure can be obtained by increasing the heating rate in annealing the warm rolled ferritic stainless steel.
Figure 2B:
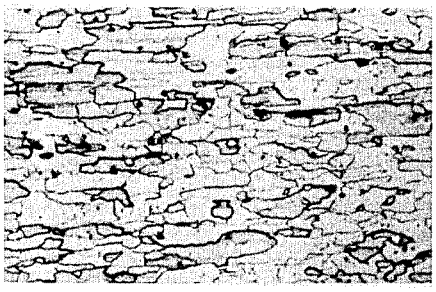
Figure 2C:
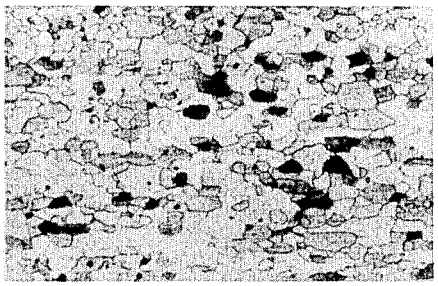
Figure 3A:
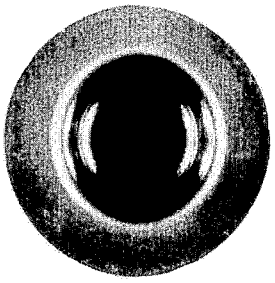
FIGS. 3*a*, 3*b* and 3*c* show different appearances of articles drawn from sheets produced in the process of the warm rolling followed by cold rolling in single stage(a), the conventional hot rolling followed by cold rolling in two stages with an intermediate anneal(b) and the conventional hot rolling followed by cold rolling in single stage(c) from a titanium-stabilized ferritic stainless steel.
Figure 3B:
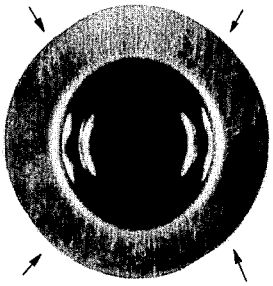
Figure 3B:
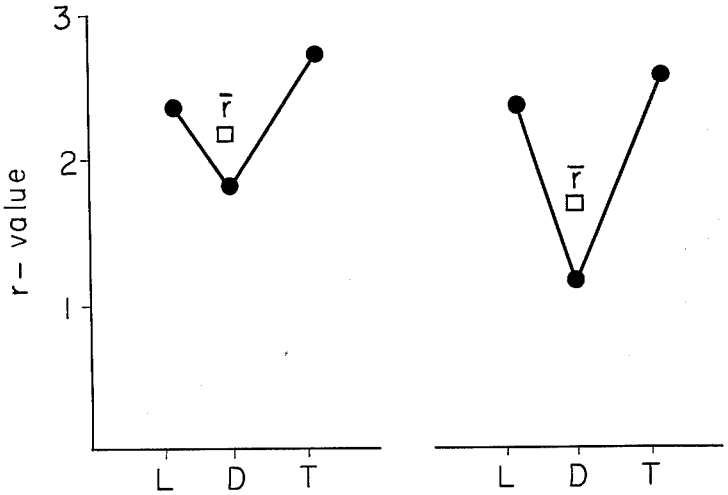
Figure 3C:
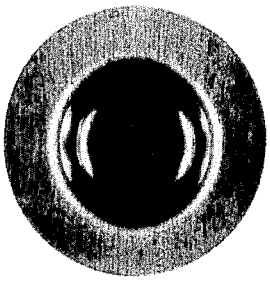
Figure 3C:
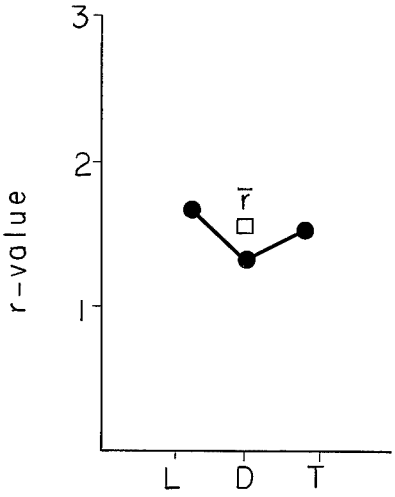

As a preparatory process of cold rolling, a short time continuous anneal is more effective in preventing ridging formation than a box anneal. This superior effect of the continuous anneal has been explained in terms of extensive break-up of bands by accelerated recrystallization in rapid heating. As can be seen in FIG. 2, recrystallization progresses extensively at a heating rate exceeding 1 deg c/s especially within the range of 5 deg c/s to 100 deg c/s.

The examples of the present invention are described in exemplary embodiments in the following.

EXAMPLE 1

In order to demonstrate the characteristic of the product processed by the present invention an ingot was produced of modified type SUS 430 steel containing 16.50% chromium, 0.01% carbon, 0.30% silicon, 1.29% manganese, 0.02% phosphor, 0.007% sulfur, 0.24% titanium, 0.15% aluminium and 0.01% nitrogen. Two slabs are made from the ingot. One of the slabs was hot rolled at low temperature in the conventional method and the hot rolled product was subjected to a box anneal. The box annealed product was cut into two parts to be cold rolled 84% in single stage and in two stages, 60% per stage, respectively. The other slab was hot rolled at finishing temperature of 900° C and coiled at 650° C. The material was then warm rolled 50% in two passes at about 600° C, descaled, and annealed for 3 minutes at 900° C in a neutral atomsphere. The annealed material was cold rolled 70% giving the same thickness of final product as those produced in the conventional process. The anneal following cold rolling was carried on at 850° C for 3 min. without regard to the prior treatments. Three kinds of products were tested by cup drawing and tension test. The result is shown in FIG. 3. In the product which was cold rolled in single stage after the conventional hot rolling, ridging forms on the entire surface of the drawn cup and $\bar{r}$-value is lowest. In the product which was cold rolled in two stages after the vonventional hot rolling, sharp, ridiging forms locallized in the area denoted by arrows and $\bar{r}$-value is moderately high, but planar anistopy of $r$-value, namely difference of $r$-values in the longitudinal, diagonal, and transverse directions, is largest, which is manifested in the elliptical appearance of drawn cup resulting in significant ear formation of the article.

In the product which is processed according to the present invention, ridging is completely free on the surface of drawn cup and $\bar{r}$-value is highest with the smallest planar anisotropy of all the products manifesting in the circular appearance of drawn cup.

EXAMPLE 2

In order to demonstrate optimum warm rolling condition, ferritic stainless steels responding to AISI Type SUS 430 and modified SUS 430, of which composition are tabulated in Table 1, were hot rolled. After finishing the hot rolling at 900° C, the materials were coiled at a temperature 50° C higher than the predetermined warm rolling temperature. The warm rolling was carried out in a 4 highreversing mill in two passes to a predetermined reduction. The warm rolled coils were air-colled to room temperature and descaled, followed by a short time continuous anneal for 3 min. at 900° C with a heating rate of 10 deg c/s in a reducing atmosphere.

The annealed materials were cooled in air, cold rolled to the thickness of 0.7 mm and annealed for 2 min. at 830° C. Tensile test coupons were cut with the tensile axis at respective angles of 0°, 45° and 90° to the rolling direction. The coupons were pulled to an elongation of 15%. The deformed specimens were subjected to surface profilometric measurement by scanning transverse to the rolling direction and, thus, perpendicular to the direction of the ridging corrugations. Ridging profile was graded by its height as shown in Table 2.

In the Ti-stabilized steel, ridging tends to form preferably in the specimen elongated at 45° to the rolling direction as was explained previously. As an evaluation of deep drawability, $\bar{r}$-value was obtained as follows:

$$\bar{r} = (r_0 + 2 \cdot r_{45} + r_{90})/4$$

were 0, 45, and 90 are ° from the rolling directions. Results were shown in Table 3, from which it is seen that if the warm rolling is effected under the conditions defined by the present invention prior to the continuous annealing an excellent combination of deep drawability and freedom from riding can be obtained.

Table 1

| | C | Si | Mn | P | S | Cr | Ti | Al | N |
|---|---|---|---|---|---|---|---|---|---|
| Steel slab (1) | 0.06 | 0.59 | 0.58 | 0.02 | 0.008 | 16.55 | — | — | — |
| Steel slab (2) | 0.01 | 0.30 | 1.29 | 0.02 | 0.007 | 16.50 | 0.24 | 0.15 | 0.010 |

Table 1

| h | Ridging rank |
|---|---|
| 0 - 10 u | A |
| 10 - 20 u | A |
| 20 - 30 u | B |
| 30 u up | C |

Table 3

| | | Relation between the off-line warm rolling condition and the resistance ridging of the final product | | | | |
|---|---|---|---|---|---|---|
| | | off-line warm rolling condition | | | | o...steel of this invention |
| kind | treat-ment | tempera-ture | reduc-tion | ridging grade | $\bar{r}$-value | |
| Steel slab 1 | 1a | 750° C | 53% | C | 1.00 | |
| | 1b | 650 | 11 | B | 0.99 | |
| | 1c | " | 31 | A | 1.19 | O |
| | 1d | " | 45 | A | 1.22 | O |
| | 1e | 550 | 12 | B | 1.05 | |
| | 1f | " | 25 | A | 1.17 | O |
| | 1g | " | 50 | A | 1.31 | O |
| | 1h | 400 | 40 | A | 1.25 | |
| Steel slab 2 | 2a | 750 | 55 | C | 1.70 | |
| | 2b | 650 | 13 | B-C | 1.61 | |
| | 2c | " | 32 | A | 1.77 | O |
| | 2d | " | 48 | A | 2.00 | O |
| | 2e | 550 | 10 | B | 1.55 | |
| | 2f | " | 23 | A | 1.87 | O |
| | 2g | " | 50 | A | 2.15 | O |
| | 2h | 400 | 40 | A | 1.79 | |

We claim:

1. A method of manufacturing a ridging free ferritic stainless steel for deep drawing applications, which comprises hot rolling a slab or ingot of the ferritic stainless steel, coiling the hot rolled material at a temperature of 750° to 450° C, subjecting the resulting material, without cooling, to a warm rolling in the temperature range of 700° and 450° C with a reduction of at least 15% by a rolling mill installed separately from the hot strip rolling line, subjecting the material to a continuous annealing and thereafter subjecting a cold rolling and a final annealing.

2. The method according to claim 1 wherein the said ferritic stainless steel has a titanium content not greater than 0.5%.

3. The method according to claim 1 wherein the continuous annealing after the warm rolling is conducted below the critical temperature of a heating rate substantially within the range of 1 deg c/s and 100 deg c/s.

* * * * *